US008009043B2

(12) United States Patent
Torvmark

(10) Patent No.: US 8,009,043 B2
(45) Date of Patent: Aug. 30, 2011

(54) METHOD FOR DETERMINING SENSOR COVERAGE, A DESIGN TOOL AND A BORDER PROTECTION SYSTEM USING THE METHOD

(75) Inventor: Halvor Torvmark, Eidsvoll Verk (NO)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 381 days.

(21) Appl. No.: 12/444,650

(22) PCT Filed: Oct. 9, 2006

(86) PCT No.: PCT/NO2006/000349

§ 371 (c)(1), (2), (4) Date: Apr. 7, 2009

(87) PCT Pub. No.: WO2008/044933

PCT Pub. Date: Apr. 17, 2008

(65) Prior Publication Data

US 2010/0073164 A1 Mar. 25, 2010

(51) Int. Cl.
*G08B 13/00* (2006.01)

(52) U.S. Cl. ..... 340/541; 340/521; 340/522; 340/552; 342/28

(58) Field of Classification Search ..... 340/506, 340/517, 521, 522, 541, 551, 552; 342/27, 342/28, 52, 147, 175

See application file for complete search history.

(56) References Cited

U.S. PATENT DOCUMENTS

| | | | | |
|---|---|---|---|---|
| 6,208,248 | B1 * | 3/2001 | Ross | 340/552 |
| 7,492,306 | B2 * | 2/2009 | Humphrey et al. | 342/28 |
| 2009/0015460 | A1 * | 1/2009 | Fox et al. | 342/53 |

* cited by examiner

*Primary Examiner* — Hung T. Nguyen

(57) ABSTRACT

A method is disclosed for determining sensor performance of a border element of homogeneous terrain, weather and vegetation properties. The border element includes a number of areas of interest, as well as a plurality of sensors. The method includes determining coordinates of the border element and areas, and determining performance data for each sensor. The coordinates and performance data is used as input parameters to a Line-Of-Sight tool for determining a coverage factor of each sensor. The coverage factor is modified for time per time unit in which function of each sensor is impaired by conditions such as bad weather, light or mobility. Then, the modified coverage factors for each sensor are summed to obtain a total sensor performance for the border element.

15 Claims, 7 Drawing Sheets

METHOD FOR DETERMINING SENSOR COVERAGE, A DESIGN TOOL AND A BORDER PROTECTION SYSTEM USING THE METHOD

TECHNICAL FIELD

The present invention relates to a method for determining the performance of a sensor or a set of sensors, in particular intended for use in systems for protecting borders against intruders.

BACKGROUND

Due to differences in social, political and economical development between countries, there will always be a flux of persons across a country's borders. Authorities want to force this traffic to go through official points of entry for control. The means for this may be physical hindrances along the borders, such as fences, or various means for observing and apprehending objects that tries to pass outside the ordinary points of entry.

Commonly, various line, point and area (volume) covering sensors are used for observing the border zones. The sensors in question may be radars, camera combinations, camera chains (line sensors), active IR or passive IR (AIR or PIR) sensors/barriers, microwave barriers and mobile sensor units, and others.

Normally, a border can not be covered all along with sensors. In some parts there are placed no sensors, the observation of the border being left to border guard patrols, while sensors are reserved for more threatened parts of the border. However, when placing sensors in an area, it is difficult to predict the effect of a given sensor, or the total protection effect obtained by a set of sensors. This is partly due to the different properties of the various sensors available. To establish the coverage obtained by a set of different sensors is not trivial.

Thus, there is a need for a structured approach for sensor performance analysis in order to synthesize surveillance solutions in border protection systems.

SUMMARY

It is an object of the present invention to provide a method covering the above mentioned need.

This is achieved in a method as claimed in the appended claim 1, where sensor performance is determined in a border element of homogeneous terrain, weather and vegetation properties. The border element includes a number of areas of interest, as well as a plurality of sensors. The method includes determining coordinates of the areas and determining performance data for each sensor. The coordinates and performance data is used as input parameters to a Line-Of-Sight tool for determining a coverage factor of each sensor. The coverage factor is a fraction of the size of the areas of interest covered by the sensors. The coverage factor is modified for time in which function of each sensor is impaired by unfavourable conditions. Then, the modified factors, called performance factor, for each sensor are summed to obtain a total sensor performance in the border element.

The invention also includes the use of the method in a border protection system design tool, and a border protection system using the method to dynamically optimize sensor settings.

Advantageous embodiments of this method appear from the following dependent claims.

BRIEF DESCRIPTION OF THE DRAWINGS

The invention will now be described in detail in reference to the appended drawings, in which.

DETAILED DESCRIPTION

The inventive method relates to a method for predicting the performance of a combination of sensors in a border protection system, and in particular the change in performance when adding, removing or relocating a sensor.

The performance is based on calculation of Line-Of-Sight (LOS) coverage for a sensor, using relevant parameters to establish the range against different types of objects (car, person, group of persons), then modifying this performance by taking into account such factors as weather, illumination and other known limiting factors for sensors.

Basic Calculation of Coverage Factor

Tools for calculating LOS coverage for sensors are included in many commercially available Geographical Information System (GIS) packages. The LOS tool uses as input calculated theoretical ranges for different sensors, using tools such as Blake-charts for radars or the Johnson criteria for electro-optical devices, coming from a sensor tool database, see below. The coordinates of the area or element in question and the properties of the sensor are used as input parameters to the LOS tool.

Border Sectorization

To find the coordinates, the border must be split (sectorized) into elements that are homogenous enough to be defined as having constant parameters regarding terrain, weather and vegetation. This work is based on the best possible maps/satellite photos/aerial photos available for the area.

Figure 1:
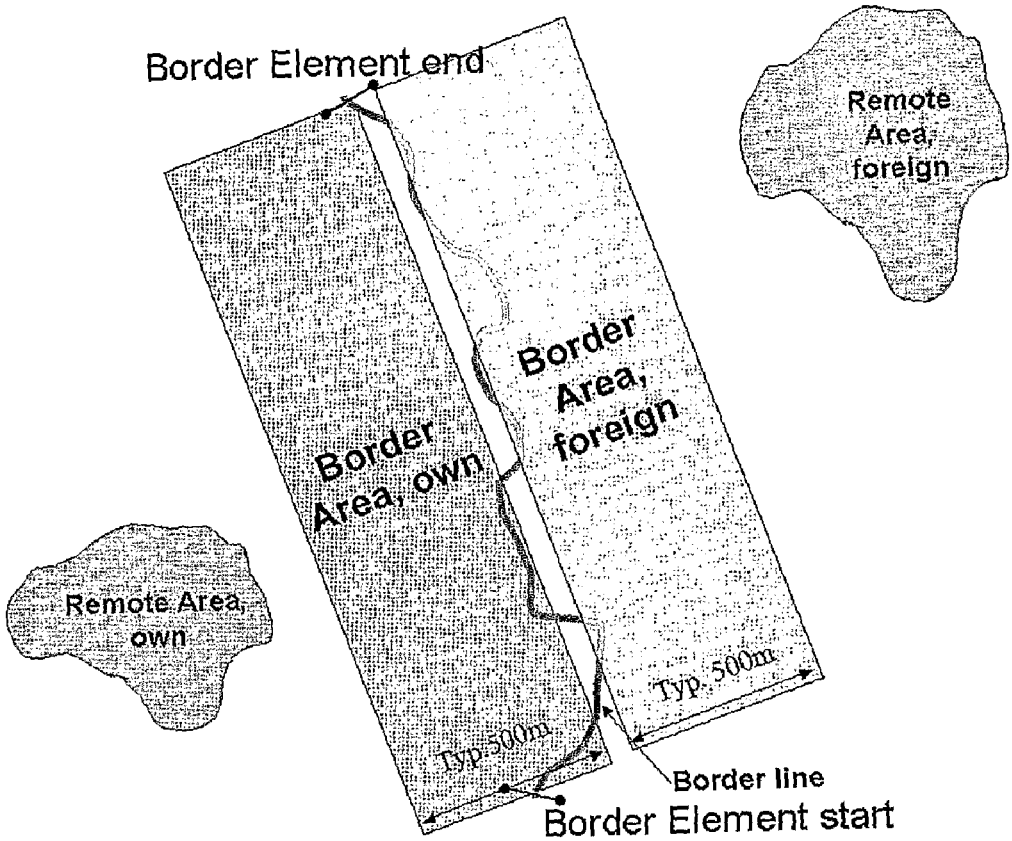
FIG. 1 is a simplified diagram illustrating the sectorization of a border, including defining areas of interest.

Operationally, the border guards want the surveillance system to cover the border line, the areas close to the border (for warning time and apprehension time) and eventually special areas further from the border (for early warning). These areas and the border line are shown in FIG. 1, only for 1 single border element. The typical width of the border areas is only given as an example, and will have to be defined by the border guards or, if not accessible, by the analyst himself. It is expected that in the standard cases, only the 2 areas along the border will be defined, but the 2 remote areas are included to cover the generic case where also remote areas may be of operational interest.

In the figure:

$BA_O$=Border Area, own side of border $BA_F$=Border Area, foreign side of border $RA_O$=Remote Area, own side of border $RA_F$=Remote Area, foreign side of border BL=Border Line It is possible to use weights to reflect the importance of the defined areas/border line. The weights should be based on the operational importance of the area of interest, and may be defined by the border guard or the analyst.

The areas have to be entered into the LOS tool, where they may be defined in different ways, depending on the particular LOS program used. The border areas are simply defined as rectangles by their 4 corners, while remote areas might need a more complex shape to model the area observable from the border or from another location inside own territory.

Basically, the needed data input from the LOS tool to the coverage calculation is the share of each of the defined areas that are covered by each individual sensor. If more than one sensor covers the areas, the input data shall be the additional share of the areas that are covered solely by the given sensor.

Sensor Pool

Figure 2:
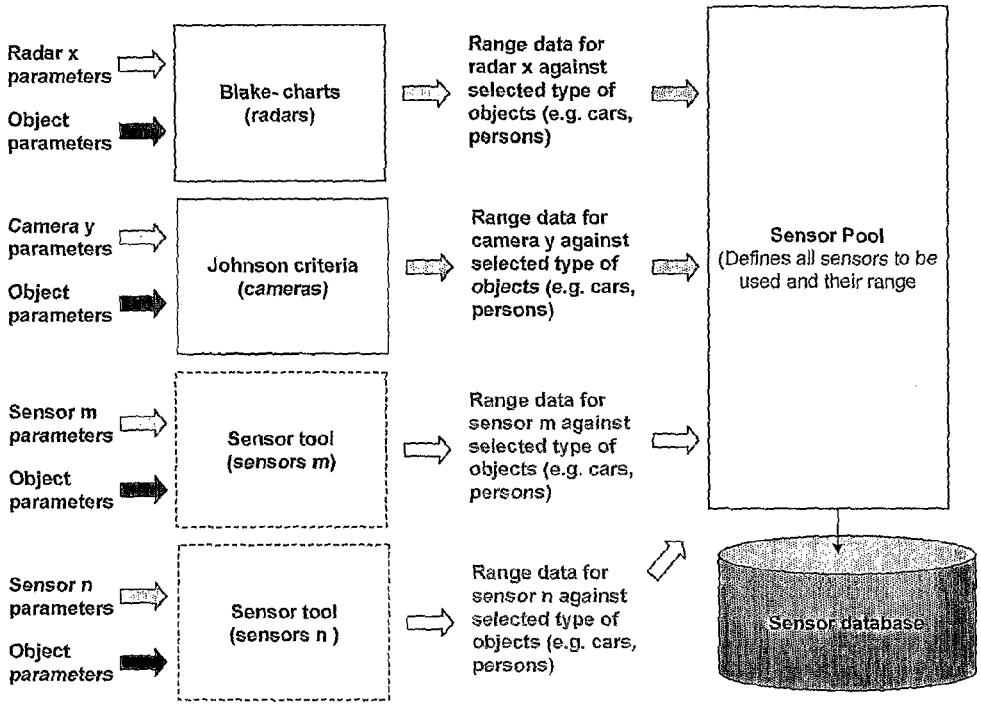
FIG. 2 is a block diagram illustrating off-line building of a sensor pool.

To be able to use the method for design of surveillance solutions, the best way to do this is to gather all possible sensors and their performance data in a database. The analyst will then be able to select a sensor and a position and the system will automatically calculate the performance and display the coverage factors resulting from the choices made. The principle of building the Sensor Pool is illustrated in FIG. 2.

Coverage Modification Factors

The coverage factor described above must be a factor between 0 and 1 representing the degree of coverage of the important areas and the border line, weighted according to the priority given by the user (Border guard) or the analyst.

The performance must also take into account the time the sensor service is available, e.g. due to weather, light or mobility. This is done in the form of a "Coverage Modification Factor" (CMF).

For a mobile unit or a patrol moving along the border, the coverage of a given element is modified by taking into account the fraction of the size of the element represents as part of the total region. For example, if an element is 2 km long while the total region is 50 km, the factor will be 2/50 since the mobile unit/patrol will be in that element for 2/50 of the time. If the mobile unit/patrol is used stationary, their performance is treated as a fixed sensor.

The performance of a line sensor is calculated as coverage of the border line only, not of the areas. The part covered is then the fraction of the element border line that the line sensor covers. This principle is used for such sensors as camera chains, AIR barriers, PIR barriers, microwave barriers, UGS (Unattended Ground Sensor) chains and active fences (fences with cable sensor).

Weather, Light and Other Performance Modifying Factors

When a new border shall be analyzed, it will be necessary to get weather data from statistics for the last years, e.g. for the last 10 years. Normally, such data are available from the Internet or by contacting Weather Centers in the actual country. The easiest available data are the days per year with rain or snow, time with fog and other extreme situations, averaged over the last years.

Generally, the rain/wind influence will be to reduce coverage of small, slow-moving objects, typically pedestrians, while bigger, fast objects are less influenced. To avoid having to handle object classes differently, the approach could be to use reduction in visibility for an "average object", giving too high reduction for pedestrians and too low for faster objects. In most environments, this approach could give satisfactorily results in coverage calculations.

To simplify calculation further, it is suggested that the CMF only takes into account the time per year (or other time unit) the weather or light conditions will impair the sensor data to a level that is not satisfactory for the surveillance functions, and reduces the coverage factor accordingly.

This simple approach is performed using the following formulas:

$$CMF = \frac{T_{year} - T_{non-functional}}{T_{year}}$$

where $T_{year}$=time units totally in a year (e.g. 365 days)

$T_{non-functional}$=time units per year that a given sensor is non-functional (e.g. 20 days)

$T_{non-functional}$ may be split into several different categories as long as the resulting influence on the sensor is strong enough to cause malfunction.

The following 2 examples illustrate the use of this CMF calculation in practice:

| Radar influence | |
|---|---|
| Full year: | 365 days/year |
| High intensity rain: | 22 days/year |
| High intensity snow: | 31 days/year |
| Coverage Modification Factor (CMF): | 0.854794521 |

| EO/IR (TV camera/Infra-Red camera) influence<br>Time units per year (day and night split into 4 units of 6 hours each) | |
|---|---|
| Full year: | 1460 time units per year |
| Heavy fog: | 102 time units per year |
| Other conditions: | 12 time units per year |
| Coverage Modification Factor (CMF): | 0.921917808 |

Other factors that influence the CMF of a sensor are:

Use of mobile sensor units (e.g. car with camera) driving along border or patrols driving or walking along border The operation time of a sensor vs storage time (e.g. for 1- or 2-shift operated mobile units)

TV-cameras that do not perform during darkness (e.g. no lighting due to power restrictions in areas without power infrastructure)

As shown, any factor making the sensor non-functional for a known period shall be included in the CMF calculation to get correct coverage factor value for the analyzed border.

Element Coverage Factor

To obtain the coverage factor for the overall border element, the coverage fractions from each sensor is summed to obtain the total coverage obtained for each area (BA, BL and RA) defined within the given border element.

$$Cov_{xx}=CMF_{S1}*c_{S1}+CMF_{S2}*c_{S2}+CMF_{S3}*c_{S3}+CMF_{S4}*c_{S4}+++CMF_{Sn}*C_{Sn}$$

Where:

$Cov_{xx}$=coverage in percent for a defined area/line and xx is either: $BA_O$, $BA_F$, $RA_O$, $RA_F$ or $B_L$ $CMF_{Sn}$=Coverage Modification Factor for sensor n $c_{Sn}$=contribution from sensor n to coverage of an area/line (NOTE: Only the part that is not covered by other, already defined sensors)

Maximum value of $Cov_{xx}$ is 1 and minimum is 0. Since this value is compensated for the time dimension (CMF), this value will in most cases not reach 1 in practice.

Figure 3:
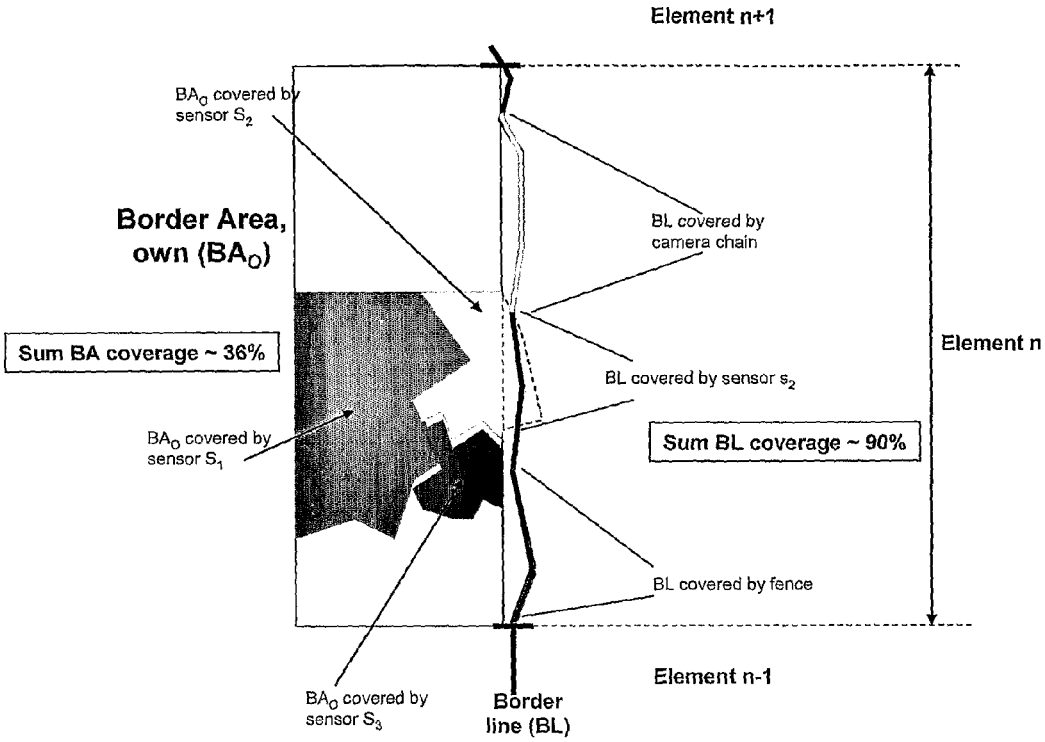
FIG. 3 is a diagram illustrating an example of a border element where a coverage factor has been determined using the inventive method.

This summing of sensor contributions is performed for all defined areas and lines within a border element, see FIG. 3, an example including Border Line and only 1 Border Area at own side of the border. In the example, the border area is covered by 3 area sensors and 2 line sensors. The CMF for these sensors is assumed to be 1 (not reduced by the CMF). As shown, the total sensor coverage for the area is around 36% (sum of the contributions from s1, s2 and s3), while the total sensor coverage for the Border Line is 90% (sum of the contributions from sensor s2, a camera chain and an active fence).

The rest of the border coverage calculation for an element takes into account the weights for the areas/lines.

$Cov_{BAO}$=Total sensor coverage of Border Area, own side of border $Cov_{BAF}$=Total sensor coverage of Border Area, foreign side of border $Cov_{RAO}$=Total sensor coverage of Remote Area, own side of border $Cov_{RAF}$=Total sensor coverage of Remote Area, foreign side of border $Cov_{BL}$=Total sensor coverage of Border Line All these $Cov_{xx}$ factors are calculated according to the formula shown above.

$W_{BAO}$=Weight factor of own Border Area coverage $W_{BAF}$=Weight factor of foreign Border Area coverage $W_{RAO}$=Weight factor of own Remote Area coverage $W_{RAF}$=Weight factor of foreign Remote Area coverage $W_{BL}$=Weight factor of own Border Line coverage The element coverage factor is then calculated according to this basic formula:

$$Cov_{BE} = \frac{Cov_{BAO} \cdot W_{BAO} + Cov_{BAF} \cdot W_{BAF} + Cov_{RAO} \cdot W_{RAO} + Cov_{RAF} \cdot W_{RAF} + Cov_{BL} \cdot W_{BL}}{W_{BAO} + W_{BAF} + W_{RAO} + W_{RAF} + W_{BL}}$$

Iterative Method for Designing a Border Surveillance System

Figure 4:
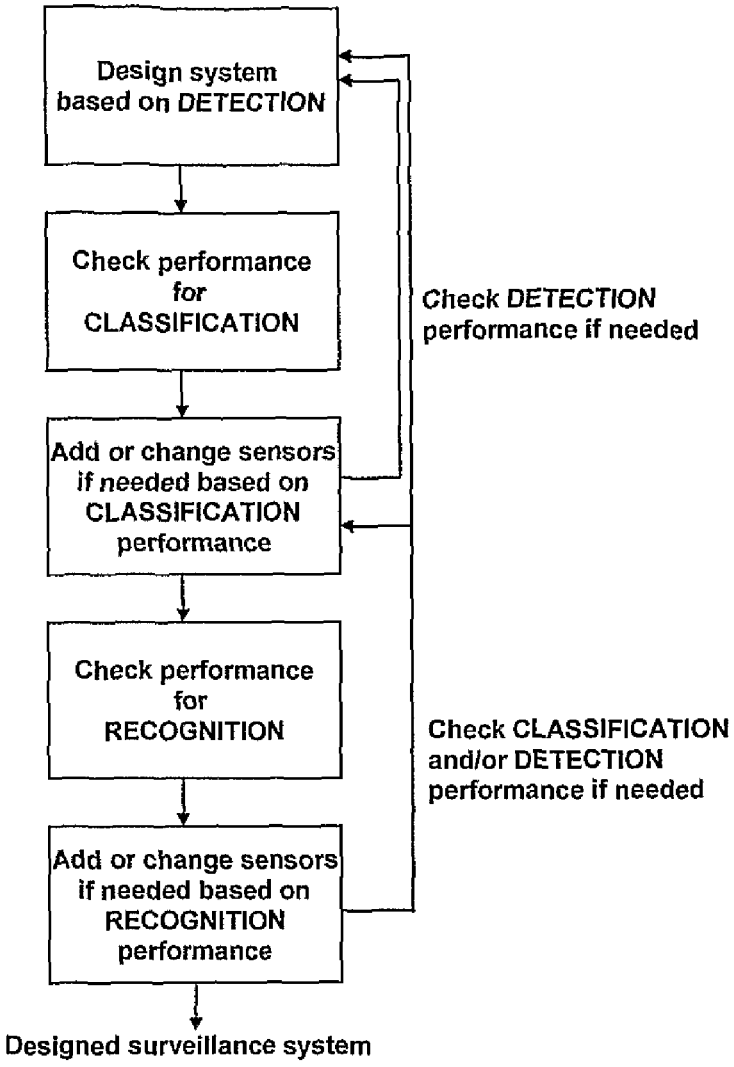
FIG. 4 is a block diagram shoving an iterative approach for determining sensor coverage.

The method for determining the coverage factor for a border element described above is used for the purpose of calculating the resulting performance from combinations of sensors to detect, classify and recognize objects crossing the border. The calculation is done separately for the 3 classes of identification since both sensor range and sensor type often will be different (e.g. radar for detection, long-range camera for classification and short-range camera for recognition). The calculation is performed in an iterative design process illustrated in FIG. 4. The design process includes a number of feedback loops so that when the design process for a system based on detection has been completed, using the method for determining element coverage factor described above, the designed system's performance for classification purposes will be checked. If the system's performance in this respect is less than desirable, a new design process based on classification criteria is performed. Then, the design process loops back to the design stage for detection, to check its performance for detection. The number, location and types of sensors are adjusted until the detection performance is satisfactory, whereupon the process again enters the classification stage, etc. This process continues until the designed system performs well both for detection and classification. Then, the process continues into the recognition stage. Based on the changes introduced in this stage, the process may either loop back into the classification stage or, if larger changes have been made, again into the detection stage at the top. When the system functions satisfactory in all respects, this design process is completed.

Calculation of Performance at Region and Total Border Level

Figure 5:
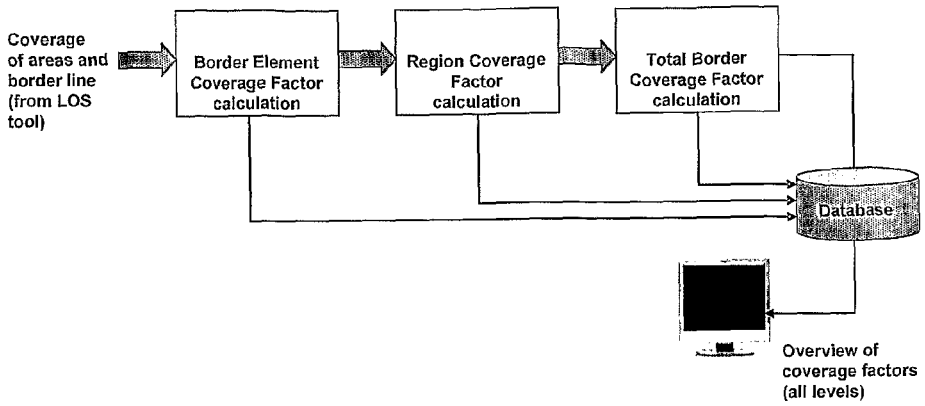
FIG. 5 is a block diagram showing the process for determining performance at region and total border level.

The coverage tool has a multi-sensor handling that sums the contributions from the different sensors and then inputs the result to the border element calculation. After calculation of the element coverage, 10 and 10 element coverage factors are used to form a "region" coverage factor" (may represent a Border Station region or just a group of 10 neighbor elements). At the next level, the region coverage factors are summed to form an average coverage factor for the whole border defined in the tool. This enlarged process is illustrated in FIG. 5

Region Performance Factor

To allow for regions along a border, e.g. Border Station areas that operate as autonomous regions, a separate region level has been introduced in the calculation method. This organization is often used by the border guards, and the region (e.g. Border Station) will often have own mobile/moving resources only operating within the region area. The "region-centered" mobile or moving resources will then be split between the border elements of that region, and can be entered in the sensor pool as special sensors for that region.

The region performance factor takes into account how large part of the region border is covered by each border element when calculating the factor.

$RL_{elx}$=Relative length of border element $x$ (part of region, e.g. 10% of region)

CovBEx=Element coverage factor for element $x$

Performance factor for region y:

$$Cov_{REGy} = \sum_{1}^{n} (Cov_{BEx} \cdot RL_{ELx})$$

where region y consists of n elements.

Total Border Performance Factor

The Total Border Performance Factor $Cov_{TOT}$ takes into account how large part of the total border is covered by each Region when calculating the factor, like the calculation of the Region Performance Factor.

RLREG$y$=Relative length of region $y$ (part of total border, e.g. 8% of border)

CovREG$y$=Region performance factor for region $y$

Total performance factor for border:

$$Cov_{TOT} = \sum_{1}^{m} (Cov_{REGy} \cdot RL_{REGy})$$

where total border consists of m regions.

The method described above can be applied to a fielded surveillance system for making automatic decisions on how to change/adjust the sensor system to compensate for failing sensors, either permanent or for limited periods. The Sensor Pool database would then need to be extended to include the allowable changes to the individual sensor. Both changed locations (for human resources or mobile sensors) and changed coverage sectors may be tested to find the optimal solution for the surveillance system. As an optional possibility, the method can be used to suggest additional sensors in case of detecting failure. The Sensor Pool database could then be used to select the new sensor type. The inputs to the performance tool from the Border Protection system are the actual surveillance sensor configuration and the status of all sensors. Other data used for the design of the fielded system need to be available for the calculations. The system is triggered by a status signal from a sensor control unit (part of the border protection management system) showing that a major sensor has failed, and by using configuration data for the local area (i.e. the actual border element and the neighbouring elements) a series of simulations with changed sensor configurations is performed, using the available sensor resources in the elements. The allowed changes must then be part of the sensor descriptions from the Sensor Pool, such as change of location for mobile sensors or human resources, change of height for variable masts, change of coverage sector for turn able sensors. The performance factors at all levels (element-region-total border) will be calculated and stored for each simulation, and in the next step, the configuration with highest performance factor is selected. Following the decision, the system could send automatic orders from the border protection management system to human and/or mobile resources or use the sensor control and management system to alter the setup of other types of sensors (e.g. change camera Pan/Tilt/Zoom parameters or scanning zone of a radar).

Figure 6:
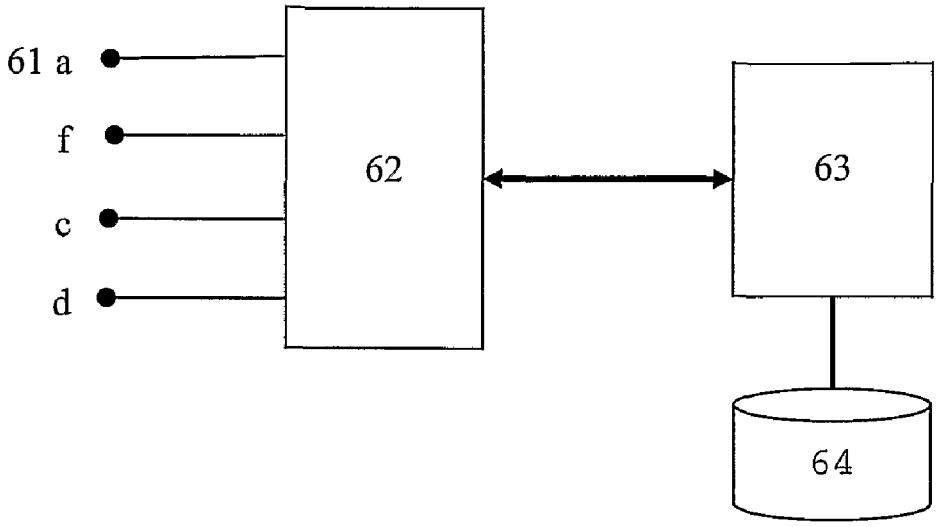
FIG. 6 is a block diagram illustrating a possible system for implementing the inventive method.

A border protection system that is able to implement the method described above is illustrated in FIG. 6. The system includes a sensor control unit 62 connected to the sensors 61 *a-d* in at least one border element. The sensor control unit 62 will normally be located in a border station, and may be integrated in the border station's computerized control and maintenance system. The sensor control unit 62 is adapted to monitor the sensors 61 *a-d*, and detect if a sensor falls out or develops a disorder, either due to technical reasons, unfavourable weather conditions such as local fog, or vandalism. The sensor control unit 62 is connected to a performance control unit 63. The sensor control unit includes a number of databases 64, such as a sensor performance data pool mentioned earlier, and may be a separate server connected to several sensor control units, or incorporated in the border station's control and maintenance system.

In case the sensor control unit 62 detects that a sensor is missing, the sensor control unit 62 will inform the performance control unit 63. The performance control unit 63 will then perform a sensor performance calculation process. The process will involve the sensors in the border element in question. The process includes calculation of sensor performance for the element, as described above, with several possible locations of each sensor, several possible orientations of each sensor (in order to use another sector of coverage, e.g. for a camera or scanning radar), or several possible setting of detection range (e.g. for a camera). This process is iterated until it converges on the largest possible sensor performance obtainable for the border element with the sensors. The performance control unit 53 may then order the sensor control unit 52 to change the settings of the sensors and/or present this information on a screen or printer enabling the border guards to initiate the new settings or other changes in patrolling schemes, etc.

Figure 7:
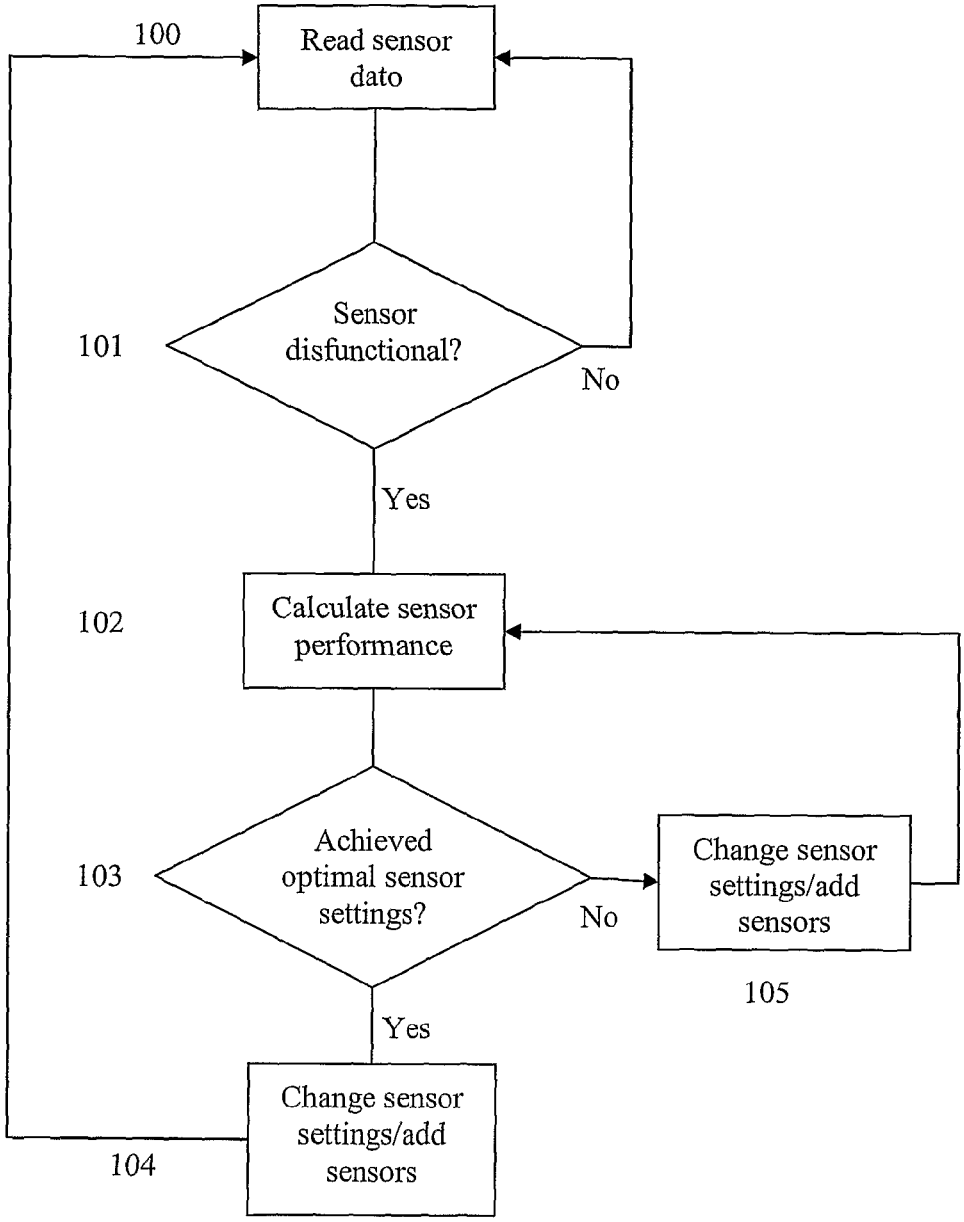
FIG. 7 is a sequence diagram illustrating a sensor performance optimizing process utilizing the inventive method.

The procedure described above is illustrated in the sequence diagram in FIG. 7. In the start position 100 the system is continuously reading and monitoring the sensors. If a sensor goes missing, step 101, the sensor performance of the border element is recalculated in a loop 102, 103, 105. The loop 102, 103, 105 runs until the possible combinations of sensor changes have been simulated, according to data from the Sensor Pool. Then, in the next step, all performance factors from the simulations are compared and the one giving highest performance factor is selected. When the loop is finished, the settings of the sensors are changed into the optimum settings, step 104, whereupon the process returns to the start position in step 100.

While the inventive method has been described for use in systems for the protection of a country's borders, it may as well be used in other, smaller scale contexts, such as for determining the sensor coverage in a system protecting the surroundings of a power plant, air port, or other relatively large infrastructures. It is also not limited to systems aimed at detecting persons, but may also be used in systems detecting air or land borne vehicles, or sea or underwater vessels.

What is claimed is:

1. A method for determining sensor performance in a border element of homogeneous properties, the border element including a number of areas of interest, the border element including a plurality of sensors, comprising the steps of:

determining coordinates of the border element and the areas of interest;

determining performance data for each sensor;

determining a coverage factor of each sensor using a Line-Of-Sight tool, with the coordinates and performance data as input parameters, the coverage factor being a fraction of the size of the border element and areas covered by the sensors;

modifying the coverage factor for time per time unit in which function of each sensor is impaired by unfavorable or limiting conditions; and summing the modified coverage factors for each sensor to obtain a total sensor performance for the border element.

2. The method of claim 1, wherein said areas of interest are at least one of the group consisting of:

Border Area, own side of border ($BA_O$);

Border Area, foreign side of border ($BA_F$);

Remote Area, own side of border ($RA_O$);

Remote Area, foreign side of border ($RA_F$); and

Border Line (BL).

3. The method of claim 1, wherein said coverage factor is modified by determining a coverage modification factor CMF:

$$CMF = \frac{T_{year} - T_{non-functional}}{T_{year}}$$

where $T_{year}$=time units totally in a year; and $T_{non-functional}$=time units per year that a given sensor is non-functional.

4. The method of claim 3, wherein the total performance for an area of interest in said border element is obtained from:

$$Cov_{xx}=CMF_{S1}*c_{S1}+CMF_{S2}*c_{S2}+CMF_{S3}*c_{S3}+CMF_{s4}*c_{S4}+++CMF_{Sn}*c_{Sn},$$

where:

$Cov_{xx}$=coverage in percent for a defined area/line and xx is either: $BA_O$, $BA_F$, $RA_O$, $RA_F$ or $B_L$, $CMF_{Sn}$=Coverage Modification Factor for sensor n, $c_{Sn}$=contribution from sensor n to coverage of an area/line including only the part that is not covered by other sensors.

5. The method of claim 4, wherein the total sensor performance for said border element is obtained by weighting contributions from each area of interest, and summing the contributions.

6. The method of claim 5, wherein the total sensor performance is obtained from:

$$Cov_{BE} = \frac{Cov_{BAO} \cdot W_{BAO} + Cov_{BAF} \cdot W_{BAF} + Cov_{RAO} \cdot W_{RAO} + Cov_{RAF} \cdot W_{RAF} + Cov_{BL} \cdot W_{BL}}{W_{BAO} + W_{BAF} + W_{RAO} + W_{RAF} + W_{BL}}$$

where:

$Cov_{BAO}$=total sensor coverage of Border Area, own side of border;

$Cov_{BAF}$=total sensor coverage of Border Area, foreign side of border;

$Cov_{RAO}$=total sensor coverage of Remote Area, own side of border;

$Cov_{RAF}$=total sensor coverage of Remote Area, foreign side of border;

$Cov_{BL}$=total sensor coverage of Border Line;

$W_{BAO}$=weight factor of own Border Area coverage;

$W_{BAF}$=weight factor of foreign Border Area coverage;

$W_{RAO}$=weight factor of own Remote Area coverage;

$W_{RAF}$=weight factor of foreign Remote Area coverage; and $W_{BL}$=weight factor of own Border Line coverage.

7. The method of claim 3, wherein said coverage factor is determined for detection, classification and recognition use of said sensors.

8. The method of claim 1, wherein performance data for possible sensors are gathered in a sensor pool database.

9. The method of claim 1, wherein a regional performance factor for a region y is obtained from:

$$Cov_{REGy} = \sum_{1}^{n} (Cov_{BEx} \cdot RL_{ELx})$$

where region y consists of n elements, and $RL_{elx}$=relative length of border element x, $Cov_{BEx}$=Element coverage factor for element x.

10. The method of claim 9, wherein a total sensor performance factor is obtained as:

$$Cov_{TOT} = \sum_{1}^{m} (Cov_{REGy} \cdot RL_{REGy})$$

where total border consists of m regions, and $RL_{REGy}$=relative length of region y, $Cov_{REGy}$=region performance factor for region y.

11. The method of claim 1, for use in a border protection system design tool.

12. A border protection system, comprising:

a sensor control unit;

a plurality of sensors coupled to the sensor control unit, the sensors in a border element of homogeneous properties; and a performance control unit coupled to the sensor control unit;

wherein the sensor control unit is adapted to detect that a sensor is disconnected or malfunctioning, and if the sensor control unit detects that sensor is disconnected or malfunctioning, the performance control unit adapted to perform a sensor performance calculation process for the remaining sensors in the border element that remain functioning; and wherein the performance control unit is further adapted to find a set of optimum settings for the remaining sensors and inform the sensor control unit about said optimum settings, the sensor control unit being adapted to control the setting of the sensors using said optimum settings.

13. The border protection system of claim 12, wherein said sensor performance calculation process is adapted to determine a coverage factor of each of said sensors using a Line-Of-Sight tool, modify the coverage factor for time per time unit in which function of each sensor is impaired by unfavorable or limiting conditions, and sum the modified coverage factors for all sensors to obtain a total sensor performance for the border element, the system further being adapted to iterate said sensor performance calculation process with several different coverage areas of each sensor in the border element until a largest possible value for the total sensor performance is obtained.

14. The border protection system of claim 13, wherein the performance control unit is adapted to iterate said sensor performance calculation process with several possible locations and settings of sector coverage and settings of range coverage for each sensor.

15. The border protection system of claim 12, the system including a database of sensor performance data.

* * * * *